US010191420B2

(12) United States Patent
Yoshida

(10) Patent No.: US 10,191,420 B2
(45) Date of Patent: Jan. 29, 2019

(54) FIXING DEVICE AND IMAGE FORMING APPARATUS

(71) Applicant: KYOCERA Document Solutions Inc., Osaka (JP)

(72) Inventor: Takeru Yoshida, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/842,942

(22) Filed: Dec. 15, 2017

(65) Prior Publication Data

US 2018/0217531 A1 Aug. 2, 2018

(30) Foreign Application Priority Data

Feb. 1, 2017 (JP) ..... 2017-016787

(51) Int. Cl.
*G03G 15/20* (2006.01)

(52) U.S. Cl.
CPC ..... *G03G 15/205* (2013.01); *G03G 15/2028* (2013.01)

(58) Field of Classification Search
CPC ..... G03G 15/205; G03G 15/2028; G03G 15/2085
See application file for complete search history.

(56) References Cited

U.S. PATENT DOCUMENTS

2012/0082492 A1* 4/2012 Park ..... G03G 15/6573 399/324
2014/0227012 A1* 8/2014 Honda ..... G03G 15/2028 399/322
2014/0233977 A1* 8/2014 Gyotoku ..... G03G 21/20 399/96
2018/0196382 A1* 7/2018 Kasama ..... G03G 15/2028
2018/0217532 A1* 8/2018 Kikuchi ..... G03G 15/2025

FOREIGN PATENT DOCUMENTS

JP 2000-305388 A 11/2000

* cited by examiner

*Primary Examiner* — Rodney A Bonnette
(74) *Attorney, Agent, or Firm* — Studebaker & Brackett PC

(57) ABSTRACT

A first rotating body heats media on which a toner image is formed at a heating temperature. A second rotating body sandwiches the media in cooperation with the first rotating body and presses the media. A first heat supplying part supplies the first rotating body with heat. A charging part charges the first rotating body, includes a discharging electrode and an auxiliary electrode to form an electric field in cooperation with the discharging electrode, causes the discharging electrode to discharge, and charges the first rotating body with a same polarity as polarity of toner. A second heat supplying part supplies the discharging electrode with heat. A controller controls the second heat supplying part in a period in a non-fixing operation and executes heat supplying mode.

8 Claims, 14 Drawing Sheets

FIXING DEVICE AND IMAGE FORMING APPARATUS

INCORPORATION BY REFERENCE

This application is based on and claims the benefit of priority from Japanese Patent application No. 2017-016787 filed on Feb. 1, 2017, the entire contents of which are incorporated herein by reference.

BACKGROUND

The present disclosure relates to a fixing device and an image forming apparatus.

There has been widely used a fixing device that includes a rotating body having a heating source and a pressing member forming a pressure contact part in cooperation with the face of the rotating body, causes the pressure contact part to sandwich and convey a recording material, and thermally fixes a toner image, which is electrostatically adhered and formed on the face of the recording material, on the recording material. A charging means (corotron charger) that charges the face of the rotating body with the same polarity as that of toner (developer) is provided in the fixing device. The charging means provided in the fixing device prevents occurrence of electrostatic offset.

SUMMARY

In accordance with an aspect of the present disclosure, a fixing device includes a first rotating body, a second rotating body, a first heat supplying part, a charging part, a second heat supplying part, and a controller. The first rotating body is formed in a cylindrical shape and heats media on which toner images are formed at a heating temperature while rotating. The second rotating body is formed in a cylindrical shape and sandwiches the media in cooperation with the first rotating body while rotating and presses the media in cooperation with the first rotating body. The first heat supplying part supplies the first rotating body with heat with which the first rotating body heats the media. The charging part is positioned opposite to the first rotating body, charges the first rotating body, includes a discharging electrode and an auxiliary electrode to form an electric field in cooperation with the discharging electrode, causes the discharging electrode to discharge in a state where the electric field is formed, and charges the first rotating body with a same polarity as polarity of toner. The second heat supplying part supplies the discharging electrode with heat that enables a temperature of the discharging electrode to be higher than the heating temperature. The controller controls the second heat supplying part in a period in a non-fixing operation and executes heat supplying mode in which heat that allows the temperature of the discharging electrode to be higher than the heating temperature is supplied to the discharging electrode.

In accordance with an aspect of the present disclosure, an image forming apparatus includes a forming part that forms toner images on media and the fixing device that fixes the toner images, formed by the forming part on the media, to the media.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
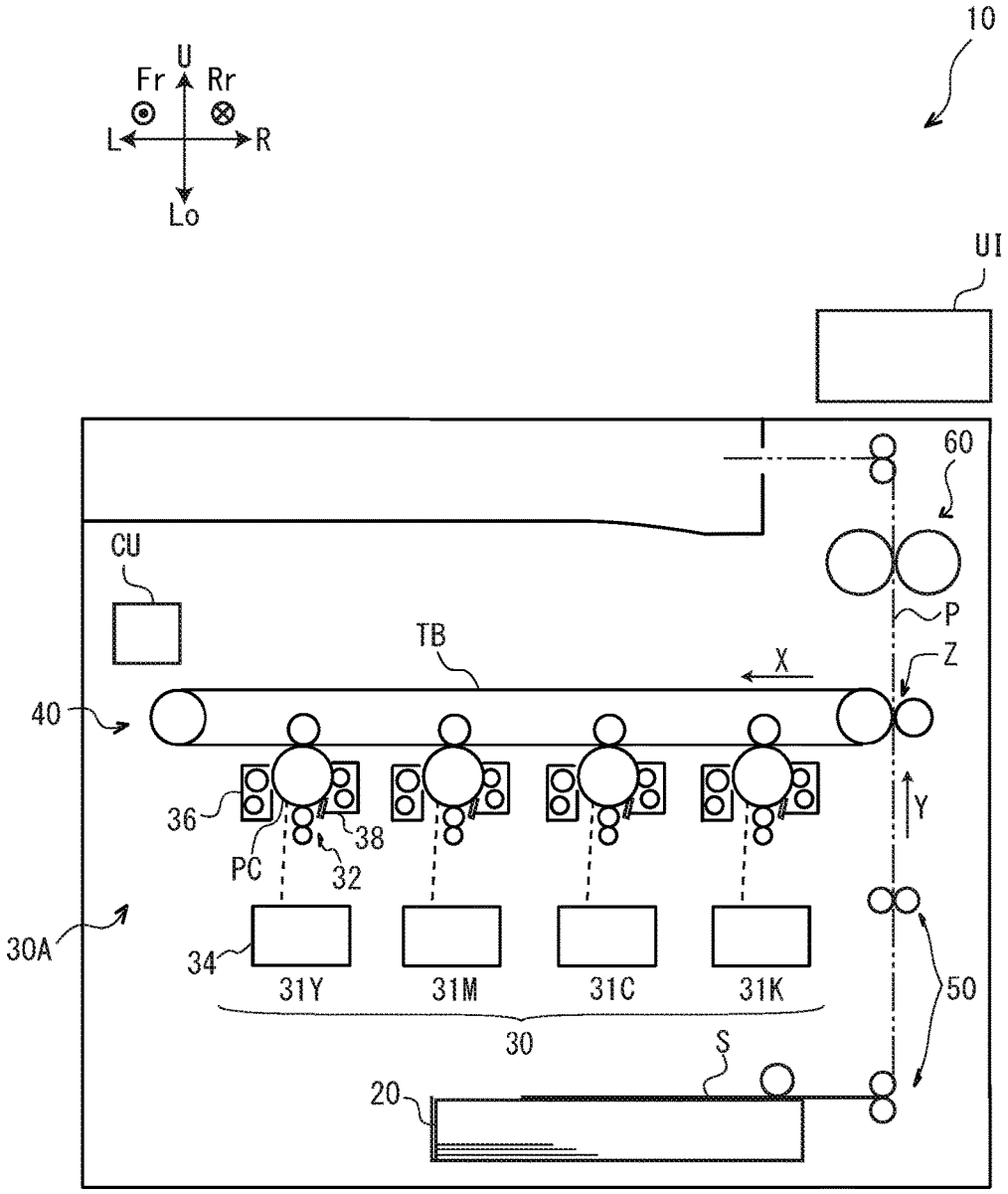
FIG. 1 is a schematic view of an image forming apparatus, viewed from a front side, in an embodiment (hereinafter referred to as the present embodiment) of the present disclosure.

Hereinafter, an overall configuration of an image forming apparatus 10 (see FIG. 1) in accordance with the present embodiment and an image forming operation by the image forming apparatus, a configuration of the fixing device 60 (see FIG. 3) being a main component in the present embodiment and an operation of the fixing device, and effects and modified examples of the present embodiment will be described in this order.

In figures of this specification, arrows Fr and Rr respectively indicate a near side and a rear side in a device-depth direction, arrows R and L respectively indicate a right side and a left side in a device-width direction, and arrows U and Lo respectively indicate an upper side and a lower side in a device-height direction. In this specification, a side in which the image forming apparatus 10 is viewed from the near side in the device-depth direction will be described as a front side of the image forming apparatus 10.

«Configuration of Image Forming Apparatus»

Hereinafter, the image forming apparatus 10 in accordance with the present embodiment will be described with reference to FIG. 1. The image forming apparatus 10 is an electrographic apparatus that includes a sheet feeding cartridge 20, a toner image forming part 30, a transferring device 40, a conveying device 50, a fixing device 60, an input device UI (as an example of a user interface), and a controller CU.

The sheet feeding cartridge 20 has a function of storing media S.

The toner image forming part 30 has functions of executing processes of charging, exposing, and developing so as to form a toner image held on a belt TB described later. The toner image forming part 30 monochromatic units 31Y, 31M, 31C, and 31K respectively forming toner images of different colors (Y (yellow), M (magenta), C (cyan), and K (black)). Each monochromatic unit 31Y, 31M, 31C, and 31K includes a photoconductor PC, a charging device 32, an exposure device 34, a development device 36, and a cleaning device 38.

The photoconductor PC has a cylindrical shape and is driven by a driving source (not illustrated) while carrying a latent image formed by the exposure device 34, thereby rotating clockwise viewed from the front side of FIG. 1. The charging device 32 to which a voltage from a power supply (not illustrated) is applied has a function of charging the photoconductor PC. The development device 36 has a function of developing the latent image formed by the exposure device 34 on the photoconductor PC by using toner (not illustrated), as the toner image. The cleaning device 38 has a function of removing residual toner left on the photoconductor PC (toner that adheres to and remains on the photoconductor PC without being transferred after the transfer of the toner image to the belt TB) from the photoconductor PC. Note that the present embodiment shows one example in which the average charge of toner (not illustrated) forming the toner image has positive polarity.

Viewed from the front side, respective elements, except for the photoconductor PC, forming the toner image forming part 30 are positioned about the photoconductor PC clockwise in the order of the charging device 32, the development device 36, a static eliminator (not illustrated), and the cleaning device 38. The exposure device 34 forms the latent image on the photoconductor PC between the charging device 32 and the development device 36. FIG. 1 omits respective reference numerals of the elements that include the monochromatic units 31M, 31C, and 31K but exclude the monochromatic unit 31Y.

The transferring device 40 includes the endless belt TB and has the functions of primarily transferring the toner image formed by the toner image forming part 30 to the belt TB circling in the direction of an arrow X in FIG. 1 and secondarily transferring the toner image held on the belt TB to the medium S. The present embodiment refers to the combination of the toner image forming part 30 and the transferring device 40 as a forming part 30A. In other words, the forming part 30A has a function of forming the toner image on the medium S.

The conveying device 50 has a function of conveying the medium S stored in the sheet feeding cartridge 20 along a conveying path (a two-dot chain line P in FIG. 1). An arrow Y in FIG. 1 indicates the direction of conveying the medium S.

The fixing device 60 has a function of fixing the toner image secondarily transferred by the transferring device 40 on the medium S, that is, the toner image formed by the forming part 30A on the medium S. The fixing device 60 will be described later.

The input device UI is an operation panel with which a user operates the image forming apparatus 10. The use of the input device UI will be specifically described in the following explanation of the operation of the fixing device 60.

Figure 2:
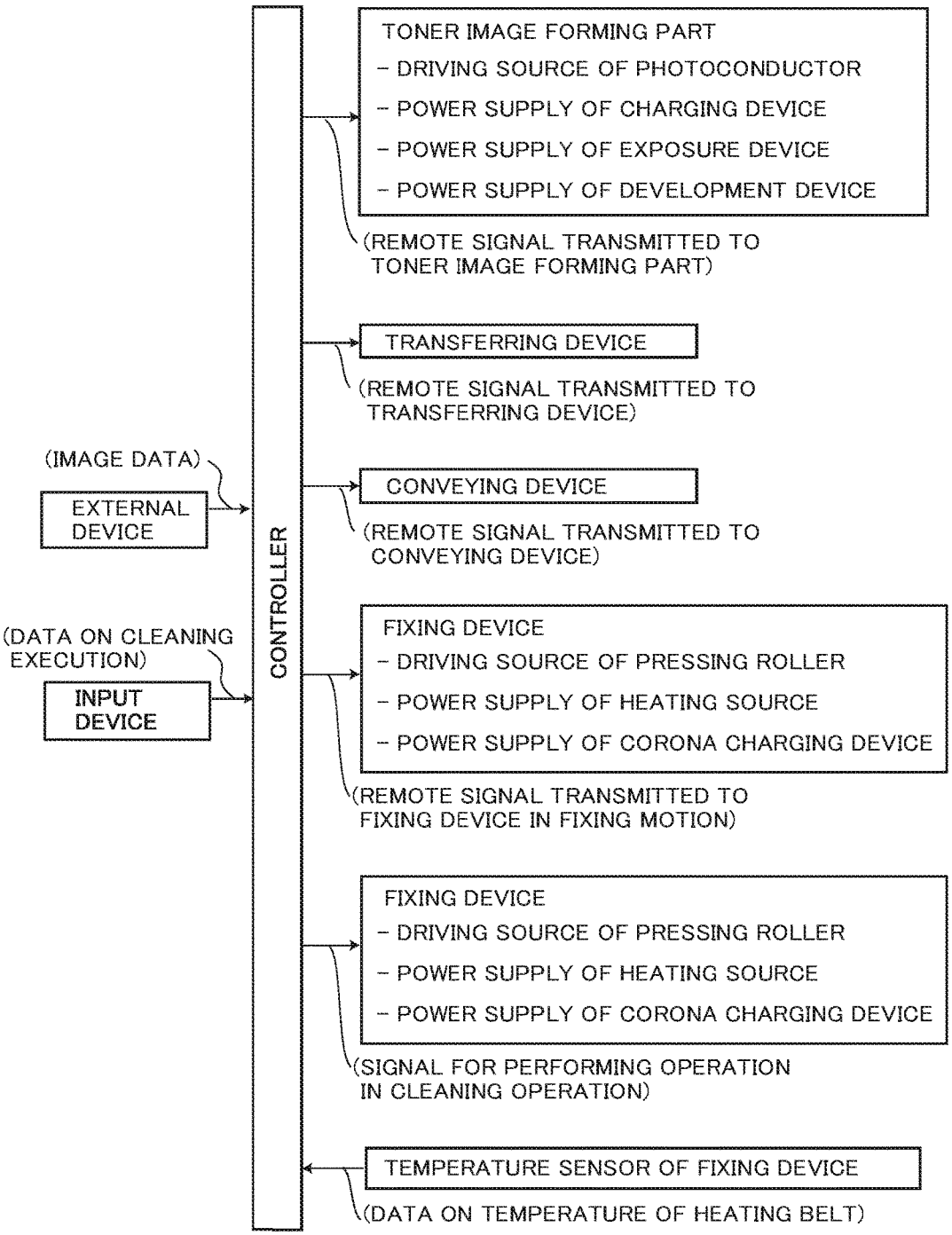
FIG. 2 is a schematic block diagram showing a relation of a controller included in the image forming apparatus to respective elements included in the image forming apparatus of the present embodiment.

The controller CU has a function of controlling respective elements including the image forming apparatus 10 (see FIG. 2). The function of the controller CU will be described in the following explanation of an image forming operation of the image forming apparatus 10 and the operation of the fixing device 60.

<Image Forming Operation>

Next, the image forming operation of the image forming apparatus 10 in accordance with the present embodiment will be described with reference to FIGS. 1 and 2.

The controller CU that has received image data from an external device (see FIG. 2) enables respective elements of the image forming apparatus 10 to be activated.

When the toner image forming part 30 is activated, in the respective monochromatic units 31Y, 31M, 31C, and 31K, the charging device 32 charges the photoconductor PC, and the exposure device 34 exposes the photoconductor PC (forms the latent image on the photoconductor PC), and the development device 36 develops the latent image on the photoconductor PC as a toner image. As a result, the toner image is formed on each photoconductor PC.

Subsequently, when the transferring device 40 and the conveying device 50 are activated, the toner image formed by the toner image forming part 30 is primarily transferred to the belt TB. Further, the medium S stored in the sheet feeding cartridge 20 is conveyed by the conveying device 50 to a position of the secondary transfer in accordance with timing when the toner image primarily transferred to the belt TB reaches a position of the secondary transfer (see a position represented by a sign Z in FIG. 1), and the toner image on the belt TB is secondarily transferred to the medium S. The medium S on which the toner image is secondarily transferred is conveyed by the conveying device 50 to the fixing device 60.

Subsequently, the fixing device 60 is activated, and the medium S on which the toner image is secondarily transferred (the toner image is formed by the forming part 30A on the medium S) is conveyed to the fixing device 60, and the toner image on the medium S is fixed to the medium S accordingly (an image is formed on the medium S).

Consequently, the medium S to which the toner image is fixed is discharged by the conveying device 50 to the outside of the image forming apparatus 10, and the image forming operation is completed.

«Configuration of Main Component (Fixing Device)»

Next, the configuration of the fixing device 60 being a main component in the present embodiment will be described in detail with reference to FIGS. 3 to 8 (mainly FIG. 3).

Figure 3:
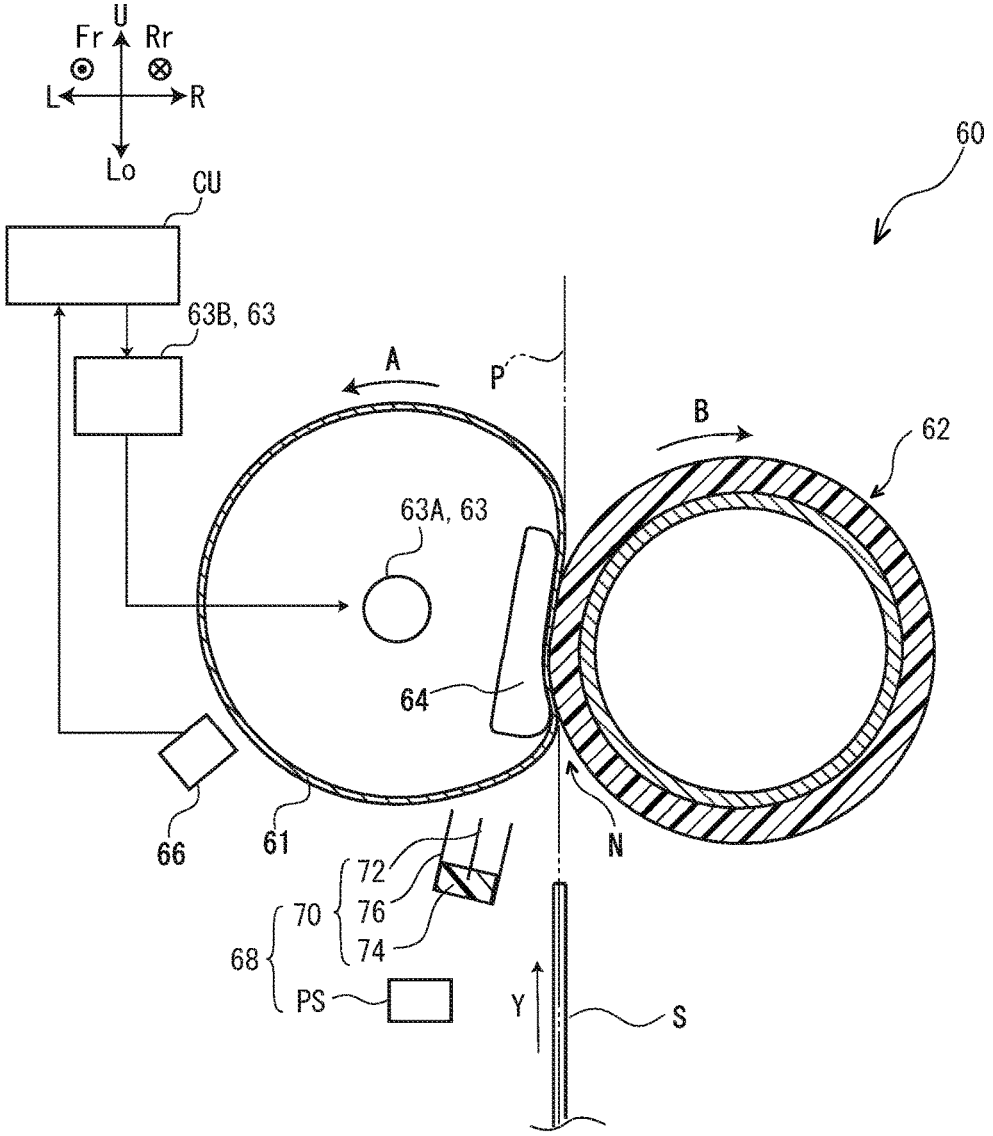
FIG. 3 is a schematic view (transverse sectional view) of a fixing device, viewed from the front side, included in the image forming apparatus of the present embodiment.

As illustrated in FIG. 3, the fixing device 60 is configured to include a heating belt 61 (one example of a first rotating body), a pressing roller 62 (one example of a second rotating body), a heating source 63 (one example of a first heat supplying part and a second heat supplying part), a curving member 64, a temperature sensor 66, a corona charging device 68 (one example of a charging part), a housing (not illustrated), and a pair of side plates (not illustrated). A main body 63A, which is described later, is composed of the heating belt 61, the pressing roller 62, and the heating source 63, each of which is long in shape and positioned to the pair of side plates in a state where the longitudinal direction thereof corresponds to the device-depth direction. The fixing device 60 is also long in shape and attached to the main body 63A of the image forming apparatus 10 in a state where the longitudinal direction thereof corresponds to the device-depth direction. The elements including the fixing device 60, except for the housing, are stored in the housing.

<Heating Belt>

The heating belt 61 has a function of heating the medium S and the toner image (toner forming the toner image) formed by the forming part 30A on the medium S at a predetermined heating temperature while rotating. The heating belt 61, as illustrated in FIG. 3, is a cylindrical belt, that is, an endless belt. A predetermined heating temperature is set to 160 degrees Celsius in one example.

The heating belt 61 is driven to rotate by the pressing roller 62 while receiving heat from the later-described heating source 63. An arrow A in FIG. 3 indicates the circumferential direction of the heating belt 61. The heating belt 61 sandwiches and presses the medium S, on which the toner image conveyed by the conveying device 50 is formed, in cooperation with the pressing roller 62 at a nip N described later. As a result, the heating belt 61 comes in contact with the medium S on which the toner image is formed while rotating, heats the medium S, and presses the medium S in cooperation with the pressing roller 62, which causes the toner image to be fixed on the medium S.

Figure 4:
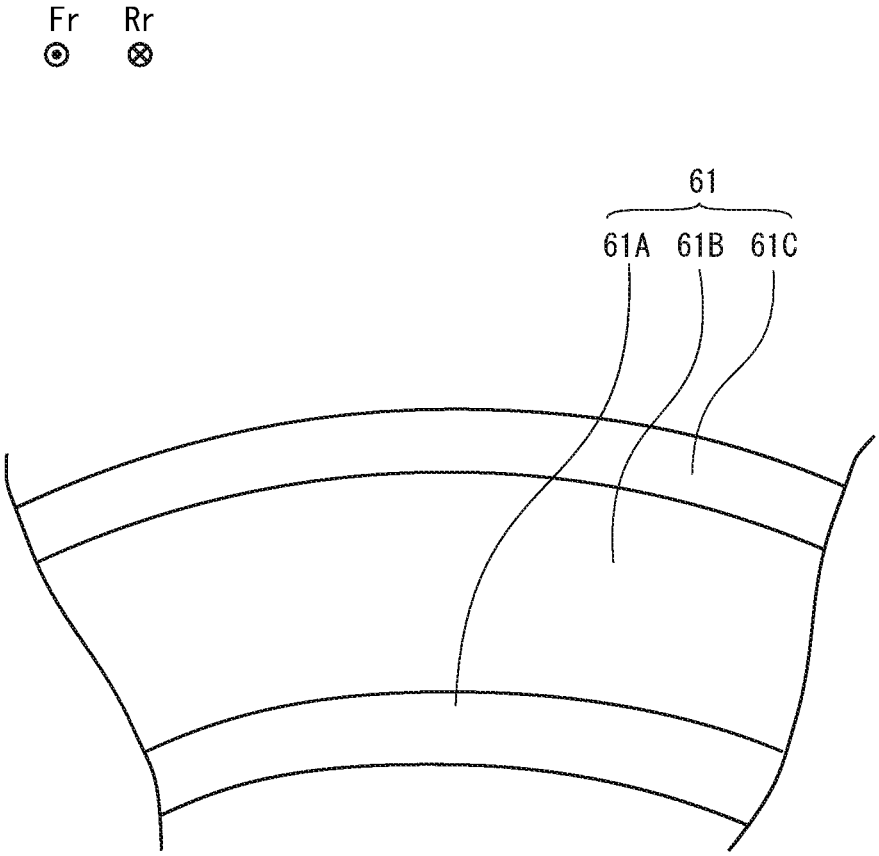
FIG. 4 is a partial sectional view of a heating belt included in the fixing device of the present embodiment.

The heating belt 61 is configured to include layers below as one example. As illustrated in FIG. 4, the heating belt 61 has three-layer structure composed of a heating layer 61A, an elastic layer 61B, and a release layer 61C. The heating layer 61A is a metallic layer as one example, and the inner face thereof constitutes the inner circumferential face of the heating belt 61. The heating layer 61A has functions of absorbing radiant heat from the main body 63A of the heating source 63 and generating heat. The elastic layer 61B covers the entire outer circumferential face of the heating layer 61A. The elastic layer 61B is formed of fluorine resin (fluorophenylalanine: PFA) having elasticity and insulation properties as one example. The elastic layer 61B has a function of elastically deforming the heating layer 61 easily. As one example, the release layer 61C is a layer formed of fluorine resin and having insulation properties and covers the entire outer circumferential face of the elastic layer 61B. The release layer 61C has a function of making it difficult for the toner to adhere to itself when the toner comes in contact with the release layer 61C in the fixing operation. The heating belt 61 (the release layer 61C of the heating belt 61) of the present embodiment has properties of being charged with negative polarity easily in contact with the medium S. Thus, when the toner (toner of which the average charge has positive polarity) is used, there is a tendency that the toner formed on the medium S adheres to the heating belt 61, which causes electrostatic offset. The heating layer 61A is grounded in connection with the frame (not illustrated) of the main body of the image forming apparatus 10.

Flanges (not illustrated) are fitted into both end parts of the heating belt 61, and the heating belt 61 is adhered and fastened to the respective flanges. The respective flanges are rotatably supported by the pair of side plates via shafts (not illustrated), each of which is fitted into the corresponding flange.

<Pressing Roller>

The pressing roller 62 is formed in a cylindrical shape and has a function of pressing the medium S and the toner image (toner forming the toner image) formed by the forming part 30A on the medium S while sandwiching the medium S and the toner image in cooperation with the heating belt 61. As illustrated in FIG. 3, the pressing roller 62 is positioned on the right side of the heating belt 61 when viewed from the device-depth direction. In a state where the pressing roller 62 and the heating belt 61 forms the nip N (see FIG. 3), the pressing roller 62 is in contact with the heating belt 61 while the right side section of the heating belt 61 is depressed by the left side section of the pressing roller 62. The nip N indicates a contact section formed by the heating belt 61 and the pressing roller 62 and disposed between the heating belt 61 and the pressing roller 62. The pressing roller 62 is driven to rotate by a driving source (not illustrated). An arrow B in FIG. 3 indicates the rotating direction of the pressing roller 62.

<Heating Source>

The heating source 63 has a function of supplying the heating belt 61 with heat with which the heating belt 61 heats the medium S. The heating source 63 is configured to include a main body 63A and a power supply 63B, as illustrated in FIG. 3. The main body 63A is a bar-shaped filament lamp as one example. The main body 63A is positioned on the inner side of the heating belt 61 while being aligned to the longitudinal direction of the heating belt 61. The main body 63A faces the inner circumference of the heating belt 61. The power supply 63B is positioned on the outside of the heating belt 61. The power supply 63B is controlled by the controller CU and has a function of supplying the main body 63A with electric power to cause the main body 63A to generate heat. As a result, the main body 63A is configured to supply heat to the heating belt 61 in a manner that the temperature of the heating belt 61 reaches the predetermined heating temperature in the fixing operation. Further, the main body 63A is configured to supply the heating belt 61 with heat (in order to) to enable the temperature of the heating belt 61 to be higher than the predetermined heating temperature, in cleaning mode (one example of heat supplying mode) executed in a non-fixing operation described later, which causes the temperature of a discharging electrode 72 to be higher the heating temperature. Note that the temperature of the heating belt 61 in the cleaning mode is set to 180 degrees Celsius as one example.

<Curving Member>

The curving member 64 sandwiches the heating belt 61 in cooperation with the pressing roller 62 and has a function of causing the heating belt 61 and the pressing roller 62 to form the nip N. The curving member 64 is positioned opposite to the pressing roller 62 with the heating belt 61 sandwiched therebetween and in contact with the inner circumference of the heating belt 61, as illustrated in FIG. 3. As for the curving member 64, the section in contact with the inner circumference of the heating belt 61 is depressed in a curved shape to the pressing roller 62. The curving member 64 is positioned to the pair of side plates.

<Temperature Sensor>

The temperature sensor 66 has a function of detecting the temperature of the heating belt 61. The temperature sensor 66 is positioned facing the outer circumference of the heating belt 61 as one example. The temperature (data on the temperature) detected by the temperature sensor 66 is transmitted to the controller CU at a predetermined cycle.

<Corona Charging Device>

Figure 5:
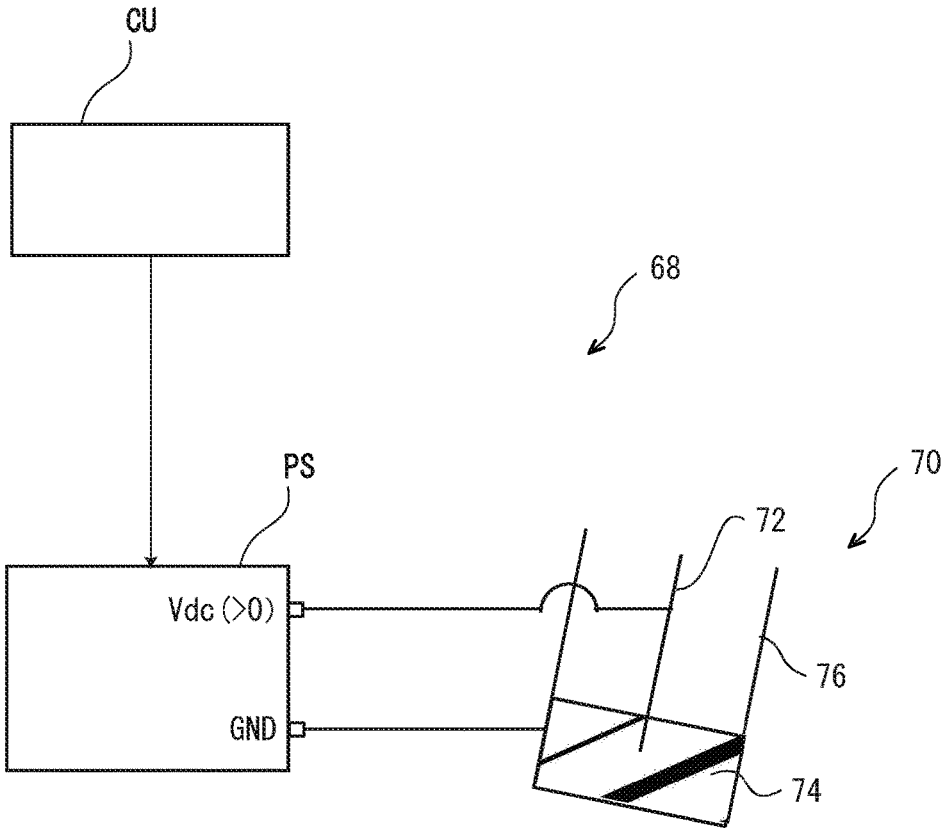
FIG. 5 is a schematic view showing a relation of a corona charging device, a power supply, and the controller included in the fixing device of the present embodiment in a fixing operation.
Figure 7:
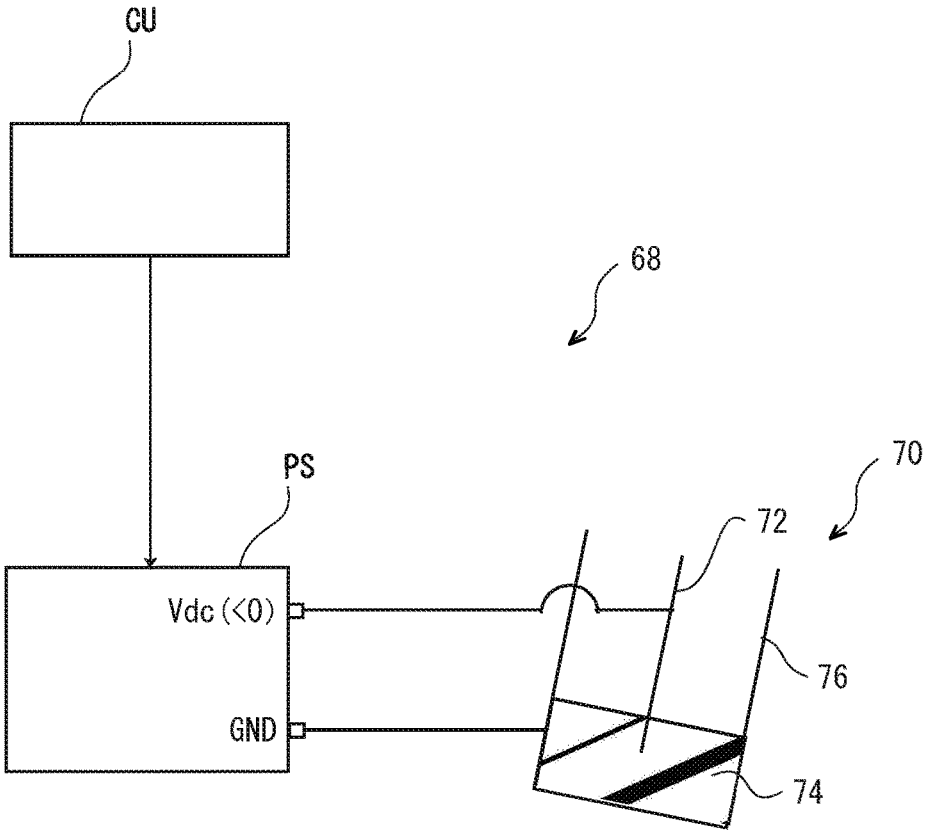
FIG. 7 is a schematic view showing a relation of the corona charging device, the power supply, and the controller included in the fixing device of the present embodiment in cleaning mode executed in a non-fixing operation.

The corona charging device 68 has a function of electrically discharging to charge the heating belt 61 (the release layer 61C of the heating belt 61) with the same polarity as that of the toner (the average charge of the toner), that is, positive polarity. As illustrated in FIGS. 3, 5, and 7, the corona charging device 68 is configured to include a charging device main body 70 (another example of a charging part) and a power supply PS. The corona charging device 68 (the charging device main body 70 of the corona charging device 68) is positioned on the lower side of the heating belt 61 and faces the outer circumference of the heating belt 61.

Note that the ground terminal of the power supply PS described later is connected to the frame (not illustrated) of the main body of the image forming apparatus 10 and grounded.

As illustrated in FIGS. 3, 5, and 7, the charging device main body 70 is configured to include a discharging electrode 72, a holding member 74, and a shield 76 (one example of an auxiliary electrode). As illustrated in one example of FIG. 8, the discharging electrode 72 is a long metallic plate, that is, a member whose one end side in the lateral direction is formed in a sawtooth shape. The holding member 74 is a long insulating member and supports the discharging electrode 72 by sandwiching a section disposed on the opposite side of the sawtooth shaped section of the discharging electrode 72 on one end side in the lateral direction of the holding member 74. The shield 76 is a long metallic casing whose one end side in the lateral direction is opened. The shield 76, together with the discharging electrode 72, forms an electric field. The holding member 74 is fixed in the shield 76. The power supply PS has functions of applying a voltage between the discharging electrode 72 and the shield 76 and forming an electric field between the discharging electrode 72 and the shield 76. Further, the power supply PS switches a switching switch (not illustrated), thereby outputting a voltage having bipolarity (positive polarity and negative polarity).

As illustrated in FIGS. 5 and 7, the corona charging device 68 is configured to cause the discharging electrode 72 to discharge by applying a direct-current voltage to the output terminal of the power supply PS in a state where the discharging electrode 72 is connected to the output terminal of the power supply PS, and the shield 76 is connected to the ground terminal of the power supply PS. In the fixing operation, the corona charging device 68 applies a voltage having positive polarity to the discharging electrode 72 and discharges corona ions having positive polarity from the discharging electrode 72. As a result, the corona charging device 68 charges the heating belt 61 with positive polarity in the fixing operation. In contrast, in the cleaning mode executed in a non-fixing operation described later, the corona charging device 68 applies a voltage having negative polarity to the discharging electrode 72 and discharges corona ions having negative polarity from the discharging electrode 72. That is, in the cleaning mode, the corona charging device 68 controlled by the controller CU forms an electric field in the direction opposite to that of the electric field formed in the fixing operation between the discharging electrode 72 and the shield 76.

«Operation of Fixing Device»

Next, the operation of the fixing device 60 of the present embodiment is classified into the fixing operation and an operation in the cleaning mode (heat supplying mode) executed in a non-fixing operation and will be described below.

<Fixing Operation>

The fixing operation of the present embodiment will be described with reference to FIGS. 2, 3, 5, and 6. First, the controller CU that has received image data from an external device (not illustrated) transmits a remote signal to perform the fixing operation to the fixing device 60 (see FIG. 2). Then, the controller CU drives the driving source (not illustrated) of the pressing roller 62, which allows the pressing roller 62 to rotate. In accordance with this, the heating belt 61 is driven to rotate by the pressing roller 62. The controller CU activates the power supply 63B of the heating source 63 and causes the power supply 63B to supply electric power to heat the main body 63A. Following this, the heating belt 61 to which the heat (radiant heat) generated from the main body 63A is supplied is heated. In this case, the temperature of the heating belt 61 is detected by the temperature sensor 66 at a predetermined cycle. The temperature (data on the temperature) detected by the temperature sensor 66 is transmitted to the controller CU at a predetermined cycle (see FIGS. 2 and 3). The controller CU causes the power supply 63B to adjust the electric power that the power supply 63B supplies to the main body 63A in a manner that the temperature detected by the temperature sensor 66 corresponds to a predetermined heating temperature.

Next, the controller CU activates the corona charging device 68. Specifically, the controller CU causes the power supply PS to apply a predetermined direct-current voltage (Vdc in FIG. 5) to the discharging electrode 72. Following this, an electric field that is attributed to the direct-current voltage having positive polarity, the structure of the charging device main body 70, and clearance with respect to the heating belt 61 is formed between the discharging electrode 72 and the shield 76. As a result, the corona charging device 68 (or the charging device main body 70) causes the discharging electrode 72 to electrically discharge so as to charge the heating belt 61 with positive polarity, that is, the same polarity as that of the toner (the average charge of the toner) in a state where the electric field is formed between the discharging electrode 72 and the shield 76 (see FIG. 6).

When the entire medium S on which the toner image is formed by the forming part 30A passes through the nip N, the controller CU stops the driving source of the pressing roller 62, the power supply 63B of the heating source 63, the power supply PS of the corona charging device 68, and the temperature sensor 66 and completes the fixing operation.

Figure 6:
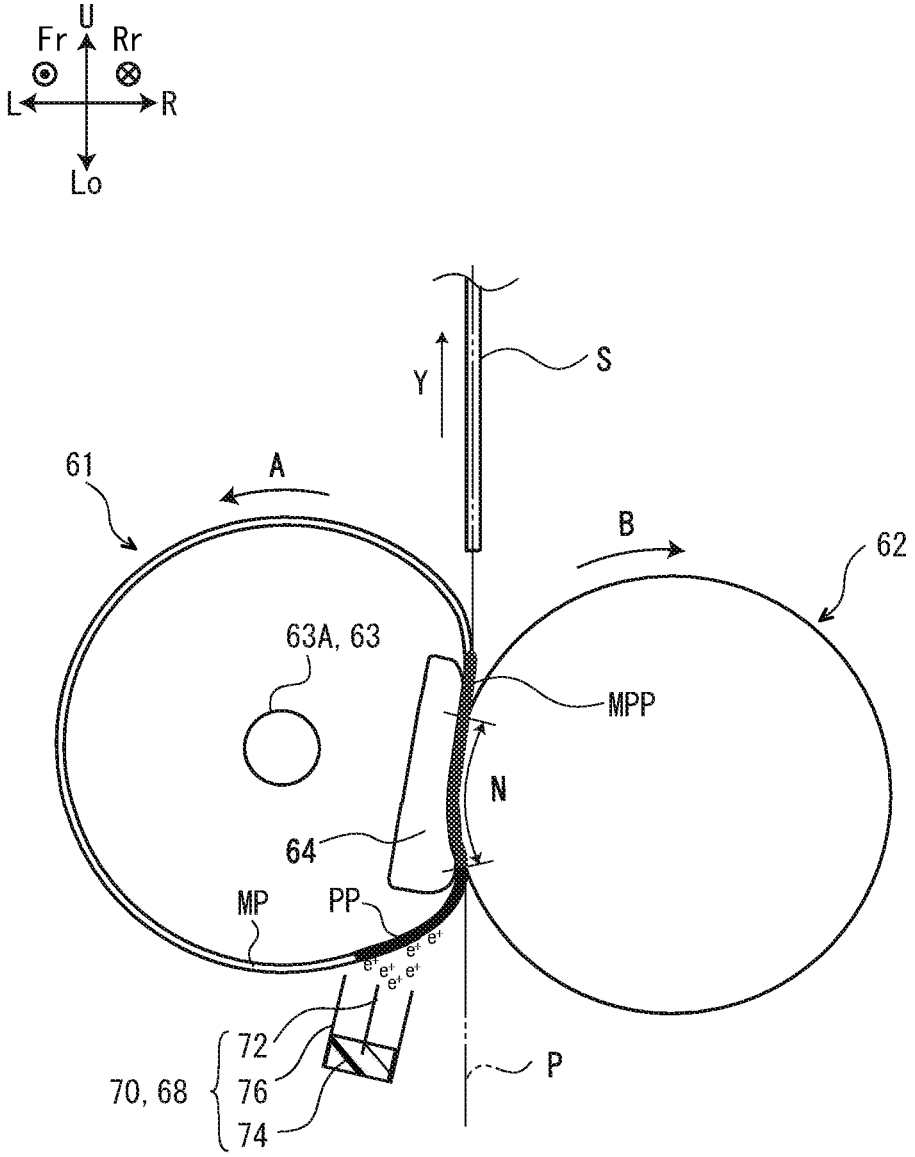
FIG. 6 is a schematic view (transverse sectional view) of the fixing device of the present embodiment viewed from the front side, which shows the charging distribution of the heating belt in the fixing operation.

Note that FIG. 6 indicates the charging distribution on the parts of the heating belt 61 that is driven to rotate by the pressing roller 62. Apart (white part) pointed by a sign MP is a part charged with negative polarity on the heating belt 61, and another part (black part) pointed by a sign PP is a part charged with positive polarity on the heating belt 61, and another part (gray part) pointed by a sign MPP is a part on which the part charged with positive polarity is being changed with negative polarity, on the heating belt 61. As the charging distribution illustrated in FIG. 6, the part that has passed the nip N on the heating belt 61 is charged on the positive polarity side, compared with its original state, due to the contact with the medium S, and subsequently when the part moves to a position opposite to the charging device main body 70 in response to the rotation of the heating belt 61, ions having positive polarity (signs e+ in FIG. 6) discharged by the discharging electrode 72 are adhered to the part. As a result, the part pointed by the sign PP, that is, the part charged with positive polarity is formed on the heating belt 61.

<Operation in Cleaning Mode>

Next, an operation (hereinafter referred to as "cleaning operation") in the cleaning mode of the present embodiment will be described with reference to FIGS. 2, 3, 7, and 9. Note that the cleaning operation of the present embodiment is executed during a non-fixing operation (a period during which the fixing device 60 does not perform the fixing operation) as one example. The cleaning operation is specifically described below.

When a user presses "Button to Execute Cleaning Mode (not illustrated)" on the input device UI, the controller CU transmits a remote signal to perform the cleaning operation to the fixing device 60. Then, the controller CU that has transmitted the remote signal verifies that the fixing device 60 does not operate the fixing operation after the transmission of the remote signal and causes the fixing device 60 to perform the cleaning operation in accordance with a flowchart of control of the cleaning operation illustrated in FIG. 9. Note that the period during which the cleaning operation of the present embodiment is performed is represented as one example of a predetermined period during the non-fixing operation.

Subsequently, the controller CU activates the driving source (not illustrated) of the pressing roller 62 (see Step S10 in FIG. 9). Following this, the pressing roller 62 rotates, and the heating belt 61 is driven to rotate by the pressing roller 62 (see FIG. 3).

Subsequently, the controller CU activates the power supply 63B of the heating source 63 and causes the power supply 63B to supply electric power to heat the main body 63A. Following this, the heating belt 61 to which the heat (radiant heat) generated from the main body 63A is supplied is heated. In this case, the temperature of the heating belt 61 is detected by the temperature sensor 66 at a predetermined cycle. The temperature (data on the temperature) detected by the temperature sensor 66 is transmitted to the controller CU at a predetermined cycle (see FIGS. 2 and 3). The controller CU causes the heating source 63 to supply heat to the heating belt 61 and enables the heat to be supplied to the discharging electrode 72 via the heating belt 61 (brings the discharging electrode 72 into a state of being heated to 180 degrees Celsius), in a manner that the temperature (180 degrees Celsius as one example) of the discharging electrode 72 of the corona charging device 68 (the charging device main body 70) is higher than the aforementioned heating temperature (160 degrees Celsius as one example in the present embodiment).

Figure 9:
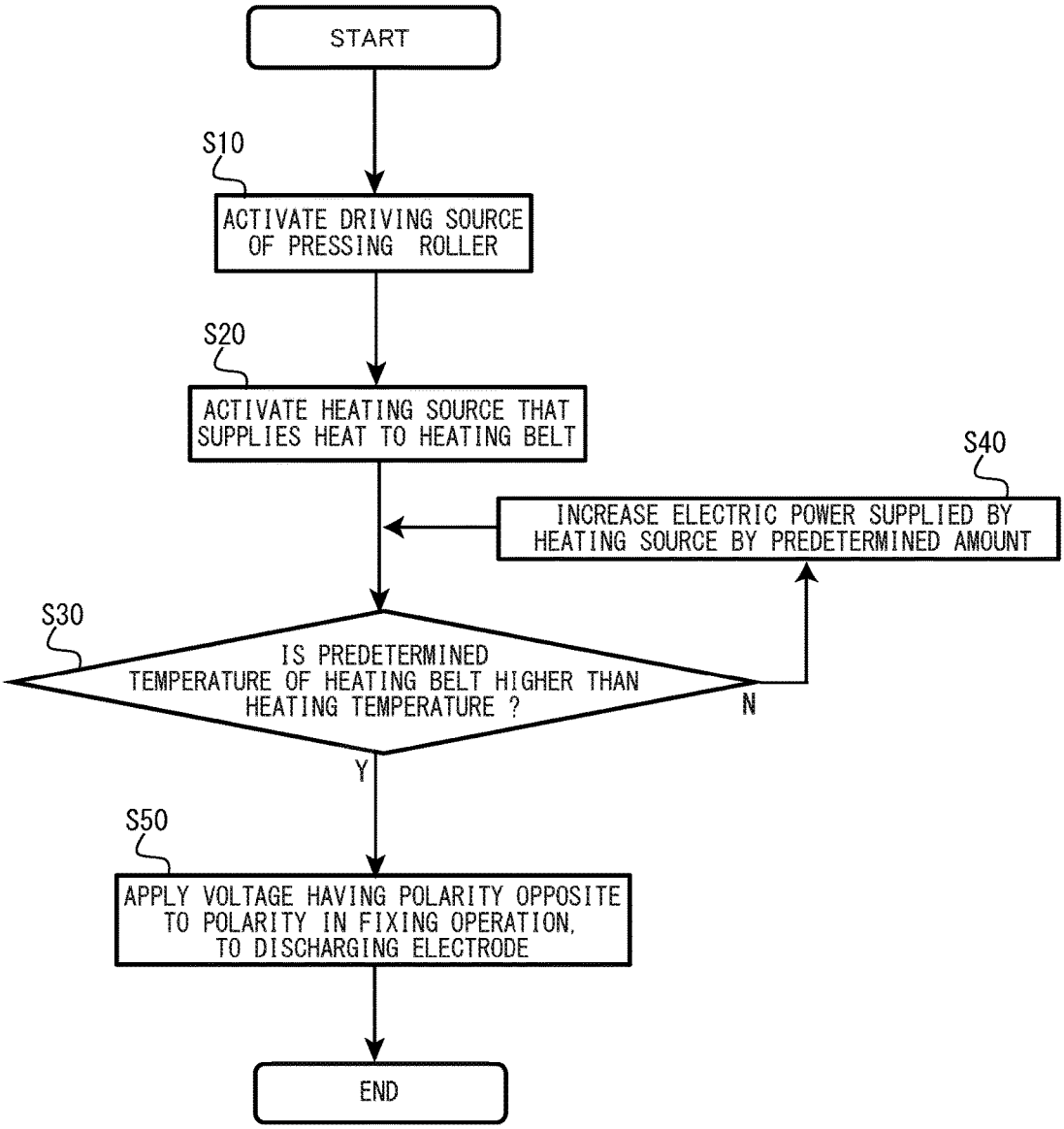
FIG. 9 is a flowchart of control in the cleaning mode of the present embodiment.

In the present embodiment, when the controller CU determines that heat having a temperature corresponding to the aforementioned high temperature (180 degrees Celsius as one example) is supplied to the discharging electrode 72, it is regarded that an affirmative determination is made by the controller CU at the determination Step S30 in FIG. 9. That is, at the determination Step S30, the controller CU determines whether the temperature of the heating belt 61 is equal to or higher than 180 degrees Celsius with the temperature sensor 66. If the controller CU makes a negative determination at the determination Step S30, the controller CU increases the output of the power supply 63B of the heating source 63 by a predetermined amount and repeats the determination Step S30. Thus, in the flowchart of control of the cleaning operation of the present embodiment, the determination Step S30 and Step S40 are repeated as long as the controller CU does not make an affirmative determination at the determination Step S30.

The controller CU that has made an affirmative determination at the determination Step S30 causes the power supply PS of the corona charging device 68 to apply a voltage having negative polarity to the discharging electrode 72 at the Step S50 (see FIG. 7) and causes the discharging electrode 72 to discharge corona ions having negative polarity.

Then, after a lapse of a predetermined period from the start of application of a voltage having reverse polarity (negative polarity) to the discharging electrode 72 at the Step S50, the controller CU stops the driving source of the pressing roller 62, the power supply 63B of the heating source 63, the power supply PS of the corona charging device 68, and the temperature sensor 66 and completes the cleaning operation.

«Effect»

Next, the effects of the present embodiment will be described with reference to drawings.

<First Effect>

For example, in the case of using a fixing device (not illustrated) having the same configuration as that of the fixing device of the present embodiment except for the execution of the cleaning operation described above (hereinafter in the case of comparison form), when the medium S on which the toner image is formed passes the nip N, impurities caused by the medium S may adhere to the discharging electrode 72 of the corona charging device 68 (the charging device main body 70). As a result, the adhesion of impurities causes non-uniformity of discharge with respect to the heating belt 61 (in the axial direction) by the corona charging device 68, which may destabilize a discharging state on a long-term basis. Further, this adhesion of impurities may lead to fixing failure.

In contrast, in the fixing device 60 of the present embodiment, the heat that allows the temperature of the discharging electrode 72 to be higher than the aforementioned heating temperature is supplied to the discharging electrode 72 in a predetermined period in the cleaning operation described above (see the case where an affirmative determination is made in the determination Step S30 of FIG. 9). That is, in the fixing device 60 of the present embodiment, the discharging electrode 72 is heated to a temperature higher than the heating temperature in a predetermined period in the cleaning operation described above. As a result, following the fixing operation, impurities adhered to the discharging electrode 72 in a solidified state are easily vaporized (easily removed).

Consequently, the fixing device 60 of the present embodiment can stabilize the discharge state (the uniformity of discharge in the longitudinal direction of the discharging electrode 72) of the corona charging device 68 (or the charging device main body 70), which charges the heating belt 61 with the same polarity as that of the toner to prevent occurrence of electrostatic offset, for a long period of time, compared with the fixing device of the comparison form. The image forming apparatus 10 of the present embodiment can prevent image forming failure caused by the destabilization of the discharge state of the corona charging device 68.

<Second Effect>

In the present embodiment, when the controller CU executes the cleaning operation, the heat that allows the temperature of the discharging electrode 72 to be higher than the aforementioned heating temperature is supplied to the discharging electrode 72, and the controller CU controls the corona charging device 68, thereby forming an electric field between the discharging electrode 72 and the shield 76 in the direction opposite to that of the electric field formed in the fixing operation (see Step S50 in FIG. 9 and FIG. 7). Thus, impurities having negative polarity, out of impurities adhered to the discharging electrode 72, receive a force attributed to the electric field in the opposite direction and their own charge and easily separate from the discharging electrode 72.

Consequently, the fixing device 60 of the present embodiment can stabilize the discharge state of the corona charging device 68 (or the charging device main body 70) that charges the heating belt 61 with the same polarity as that of the toner to prevent occurrence of electrostatic offset for a long period of time, compared with a case where the electric field is not formed between the discharging electrode 72 and the shield 76 in the direction opposite to that of the electric field formed in the fixing operation when the cleaning operation is executed.

<Third Effect>

In the present embodiment, when the controller CU executes the cleaning operation, the heat that allows the temperature of the discharging electrode 72 to be higher than the aforementioned heating temperature is supplied to the discharging electrode 72, and the controller CU controls the driving source (not illustrated) of the pressing roller 62 and causes the pressing roller 62 to rotate (see Step S10 in FIG. 9). Following this, the heating belt 61 is also rotated. Thus, impurities (gaseous impurities) vaporized from the discharging electrode 72 are easily caught in airflow generated with the rotation of the heating belt 61.

Consequently, the fixing device 60 of the present embodiment can stabilize the discharge state of the corona charging device 68 (or the charging device main body 70) that charges the heating belt 61 with the same polarity as that of the toner to prevent occurrence of electrostatic offset for a long period of time, compared with a case where the heating belt 61 is not rotated when the cleaning operation is executed <Fourth Effect>

In the present embodiment, the heating source 63 has a function of supplying heat to the discharging electrode 72 in the cleaning operation, besides a function of supplying heat, which is used by the heating belt 61 in the fixing operation, to the heating belt 61 (see FIG. 3). Thus, the fixing device 60 of the present embodiment eliminates another heating source to supply heat to the discharging electrode 72 in the cleaning operation, other than the heating source 63.

Consequently, the fixing device 60 of the present embodiment can achieve miniaturization and lower manufacturing costs, compared with a case where another heating source to supply heat to the discharging electrode 72 in the cleaning operation is provided, other than the heating source 63. This allows the image forming apparatus 10 to achieve miniaturization and lower manufacturing costs.

<Fifth Effect>

In the present embodiment, when a user presses "Button to Execute Cleaning Mode (not illustrated)" on the input device UI (see FIG. 1), the cleaning operation is executed.

Consequently, the fixing device 60 of the present embodiment can execute the cleaning operation when the user determines that the cleaning operation should be performed, in contrast to a case where the cleaning operation is not executable in response to input (executive command) from the input device UI used by a user.

<Sixth Effect>

The present embodiment achieves the image forming apparatus 10 that includes the forming part 30A to form the toner image on the medium S and the fixing device 60 to fix the toner image formed on the medium S by the forming part 30A to the medium S.

The embodiment has been described as one example of the present disclosure above, but the technical scope of the present disclosure is not limited to the embodiment above. For example, the technical scope of the present disclosure includes the following forms.

As described above, in the present embodiment, the fixing device 60 does not includes the controller CU as a constituent element. However, the fixing device 60 may include a section of controlling the fixing device 60 in the controller CU as part of the fixing device 60.

In the present embodiment, the heating belt 61 is described as one example of the first rotating body, and the pressing roller 62 as one example of the second rotating body. However, one example of the first rotating body does not have to be the heating belt 61 as long as one example of the first rotating body has a function of heating the medium S while rotating. For example, one example of the first rotating body may be a roller (heating roller). Further, one example of the second rotating body does not have to be the pressing roller 62 as long as one example of the second rotating body has functions of forming the nip N in cooperation with the first rotating body while rotating, and of pressing the medium S passing through the nip N in cooperation with the first rotating body. For example, one example of the second rotating body may be an endless belt.

The present embodiment has described that heat from the main body 63A of the heating source 63 positioned on the inner side of the heating belt 61 is supplied to the heating belt 61. However, the main body 63A of the heating source 63 may be positioned outside of the heating belt 61, as long as heat is supplied to the heating belt 61. In this case, the main body 63A, for example, may be an induction coil (not illustrated), other than a bar-shaped filament lamp.

Figure 8:
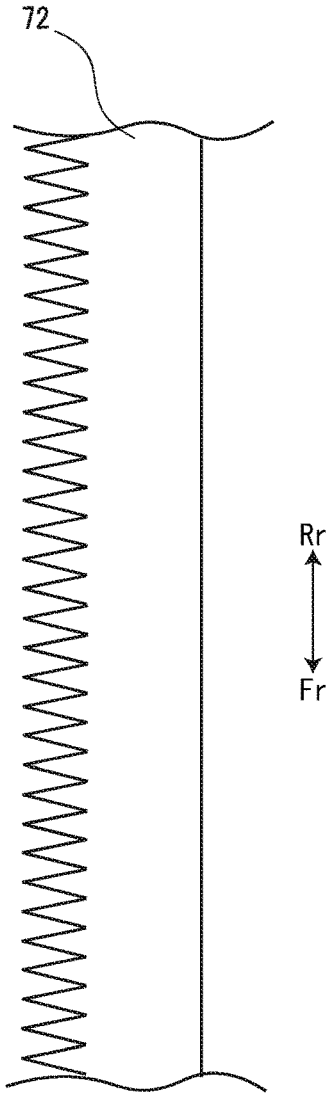
FIG. 8 is a schematic view of part of a discharging electrode of the corona charging device included in the fixing device of the present embodiment.

The present embodiment has described that the discharging electrode 72 of the corona charging device 68 is a sawtooth shaped member (see FIG. 8). However, the discharging electrode 72 does not have to be a sawtooth shaped member as long as the discharging electrode 72 has a function of discharging. For example, the discharging electrode 72 may be a simple, long, tabular member, a wire, or a member formed of a plurality of needle electrodes aligned in a row (not illustrated).

Figure 10:
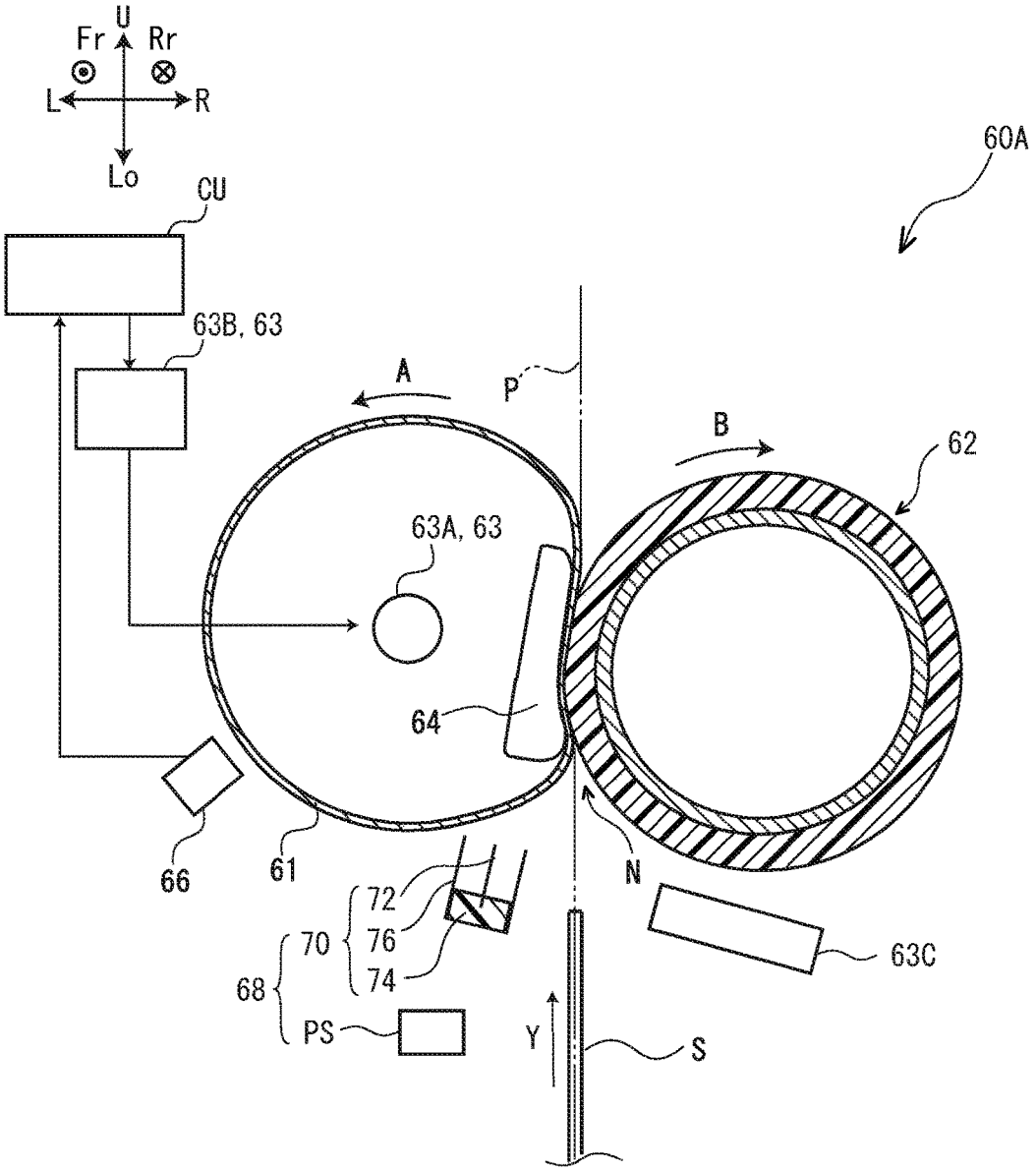
FIG. 10 is a schematic view (transverse sectional view) of the fixing device included in the image forming apparatus, viewed from the front side, in a first modified example.

The present embodiment has described that the heating source 63 has a function of supplying heat to the discharging electrode 72 in the cleaning operation, other than a function of supplying the heating belt 61 with heat used by the heating belt 61 in the fixing operation (see FIG. 3). However, it may be such that a fixing device 60A in a modified example (first modified example) in FIG. 10 is configured to include a heating source 63C, and the heating source 63C (another example of the second heat supplying part) in place of the heating source 63 is activated in the cleaning operation, thereby heating the discharging electrode 72. This modified example fails to have the fourth effect of the present embodiment, but is effective in having the first to third, and fifth effects of the present embodiment.

Figure 11:
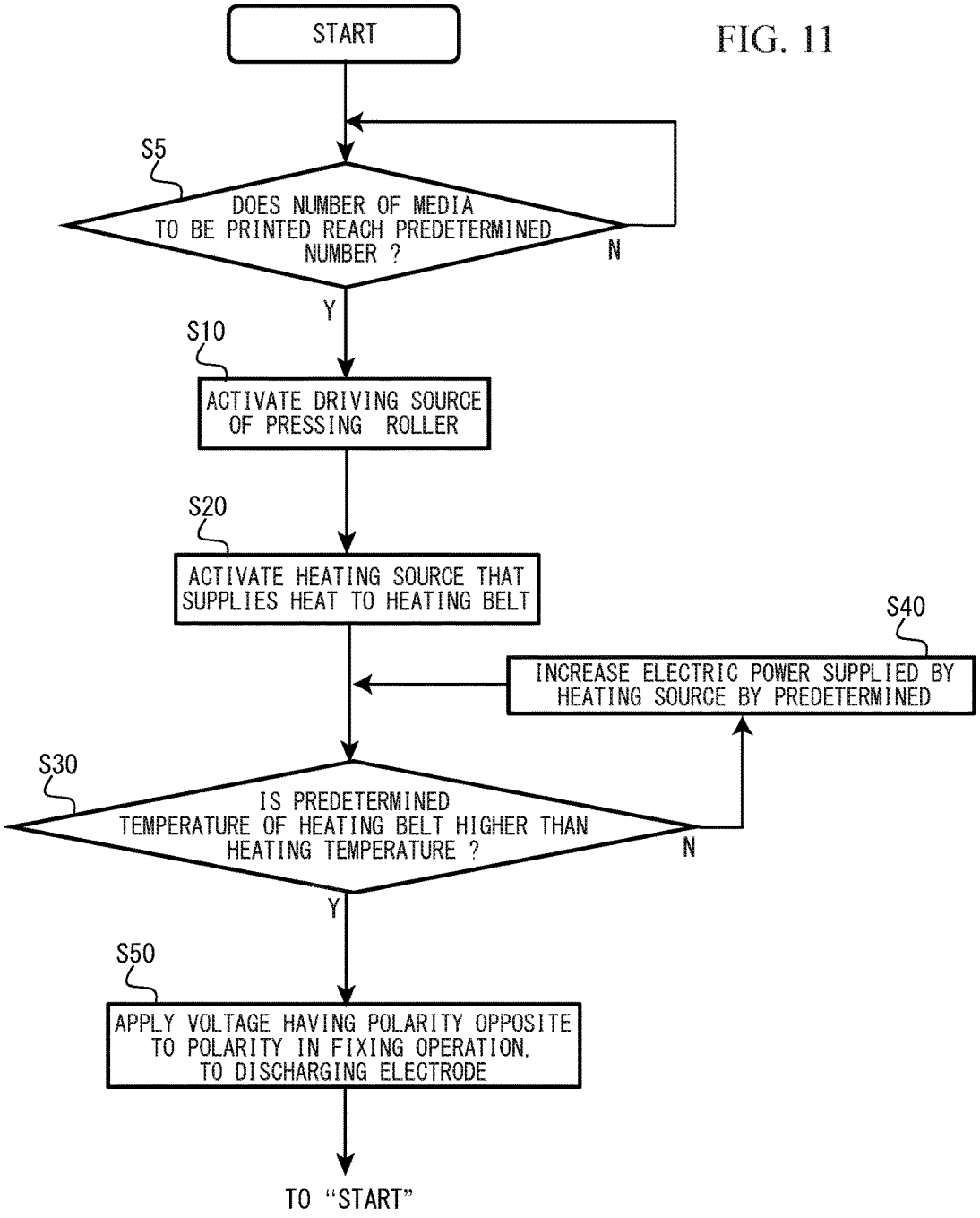
FIG. 11 is a flowchart of control in the cleaning mode in a second modified example.

The present embodiment has described that the cleaning operation is executed in response to input (executive command) from the input device UI (see FIG. 1) used by a user. However, as illustrated in the modified example (second modified example) of FIG. 11, it may be such that the cleaning operation is executed before Step S10 in the flowchart (see FIG. 9) of control of the cleaning operation of the present embodiment, and the determination Step S5 in which it is determined whether the number of media S to be printed (e.g., 500 sheets of media S corresponding to A4 size media) has reached a predetermined number is performed, thereby automatically executing the cleaning operation. In other words, at Step S5, the process of Step S10 onward may be executed when the number of media S to be printed after the execution of the previous cleaning operation is equal to or higher than a threshold value. In this modified example above, "Start" in the flowchart of control in FIG. 11 indicates a time point when the image forming apparatus 10 is initialized and started to be used. That is, the flowchart of control of the cleaning operation of the modified example is executed on a semipermanent basis, for example, from the start to the stop of use of the image forming apparatus 10.

Note that the image forming apparatus 10 of the present embodiment is effective in that the cleaning operation is automatically executed.

Figure 12:
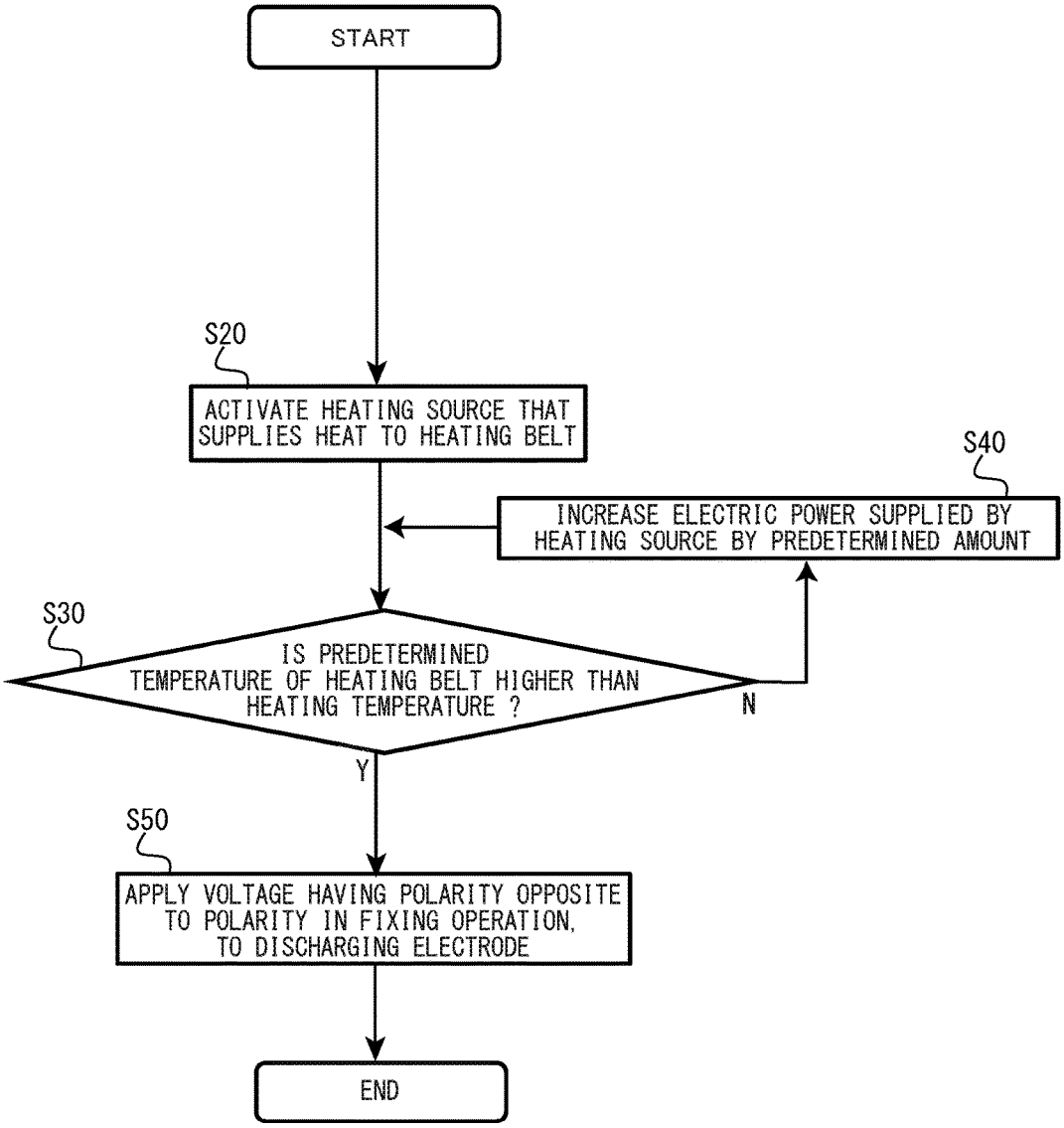
FIG. 12 is a flowchart of control in the cleaning mode in a third modified example.

The present embodiment has described that the heating belt 61 is rotated in the cleaning operation (see Step S10 in FIG. 9). However, as illustrated in the modified example (third modified example) of FIG. 12, it may be such that Step S10 (see FIG. 9) in the flowchart of control of the cleaning operation of the present embodiment is not carried out. This modified example fails to have the third effect of the present embodiment, but is effective in having the first, second, fourth, and fifth effects of the present embodiment.

Figure 13:
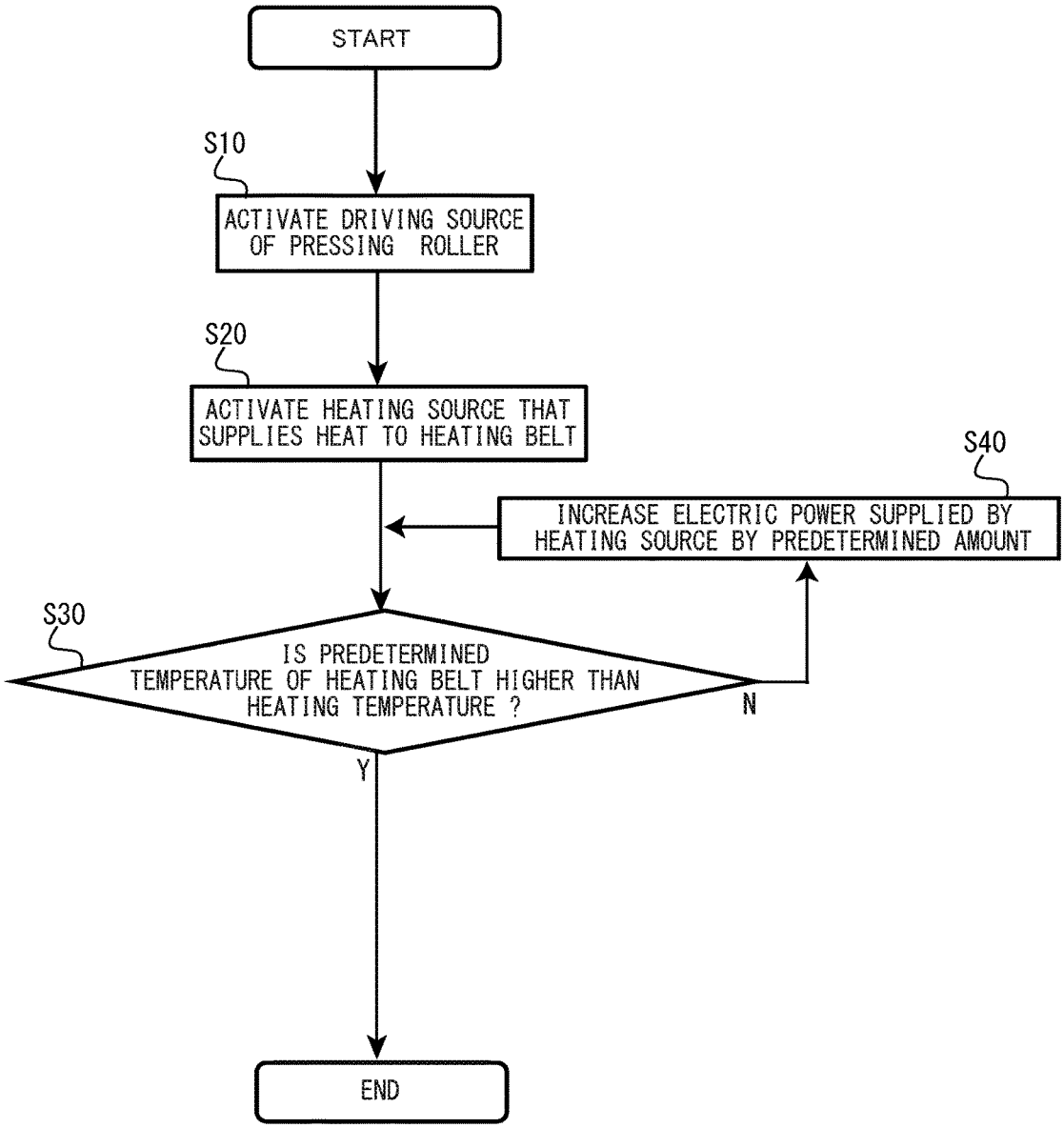
FIG. 13 is a flowchart of control in the cleaning mode in a fourth modified example.

The present embodiment has described that the electric field in the direction opposite to that of the electric field formed in the fixing operation is formed between the discharging electrode 72 and the shield 76 in the cleaning operation (see Step S50 in FIG. 9 and FIG. 7). However, as illustrated in the modified example (fourth modified example) of FIG. 13, it may be such that Step S50 (see FIG. 9) in the flowchart of control of the cleaning operation of the present embodiment is not carried out. The modified example fails to have the second effect of the present embodiment, but is effective in having the first and third to fifth effects of the present embodiment.

Figure 14:
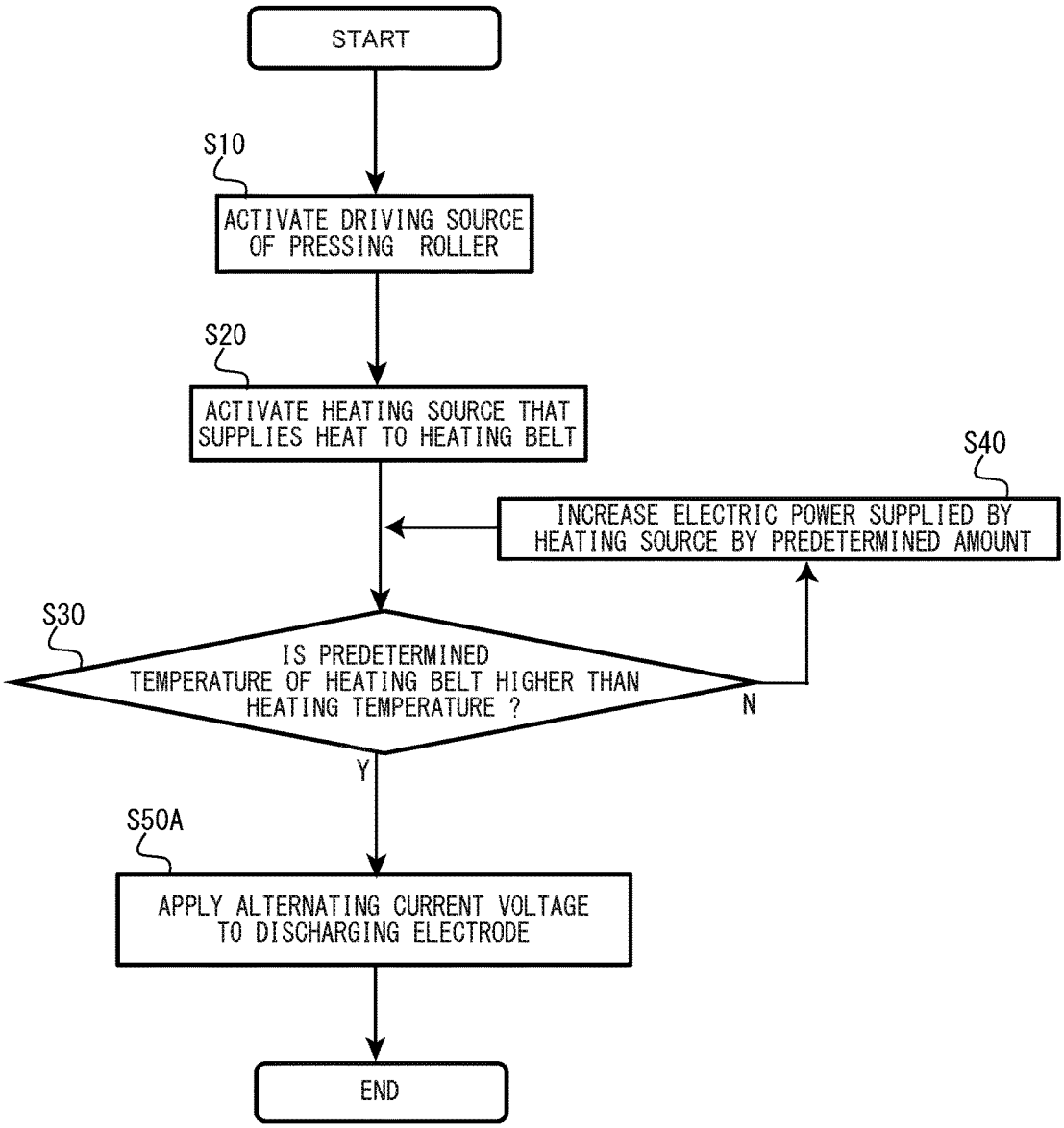
FIG. 14 is a flowchart of control in the cleaning mode in a fifth modified example.

The present embodiment has described that the electric field in the direction opposite to that of the electric field formed in the fixing operation is formed between the discharging electrode 72 and the shield 76 in the cleaning operation (see Step S50 in FIG. 9 and FIG. 7). However, as illustrated in the modified example (fifth modified example) of FIG. 14, an alternating current voltage may be applied to the discharging electrode 72 in a predetermined period as Step S50A in place of Step S50 (see FIG. 9) in the flowchart of control of the cleaning operation of the present embodiment. In this modified example, impurities having positive polarity, out of impurities adhered to the discharging electrode 72, receive a force attributed to the electric field having the same polarity in the fixing operation and easily separate from the discharging electrode 72. As described above, impurities having negative polarity receive a force attributed to the electric field having reverse polarity in the fixing operation and easily separate from the discharging electrode 72. Consequently, this modified example is effective in that impurities having positive polarity, out of impurities adhered to the discharging electrode 72, easily separate from the discharging electrode 72, in addition to the first to fifth effects of the present embodiment.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A fixing device comprising:

a first rotating body configured to be formed in a cylindrical shape and heat media on which toner images are formed at a heating temperature while rotating;

a second rotating body configured to be formed in a cylindrical shape and sandwich the media in cooperation with the first rotating body while rotating and configured to press the media in cooperation with the first rotating body;

a first heat supplying part configured to supply the first rotating body with heat with which the first rotating body heats the media;

a charging part configured to be positioned opposite to the first rotating body, charge the first rotating body, include a discharging electrode and an auxiliary electrode to form an electric field in cooperation with the discharging electrode, cause the discharging electrode to discharge in a state where the electric field is formed, and charge the first rotating body with a same polarity as polarity of toner;

a second heat supplying part configured to supply the discharging electrode with heat that enables a temperature of the discharging electrode to be higher than the heating temperature; and a controller configured to control the second heat supplying part in a period in a non-fixing operation and execute heat supplying mode in which heat that allows the temperature of the discharging electrode to be higher than the heating temperature is supplied to the discharging electrode.

2. The fixing device according to claim 1, wherein when the controller executes the heat supplying mode, the controller controls the charging part, thereby forming an electric field in a direction opposite to a direction of an electric field formed in a fixing operation between the discharging electrode and the auxiliary electrode.

3. The fixing device according to claim 1, wherein when the controller executes the heat supplying mode, the controller controls the charging part, thereby applying an alternating current voltage to the discharging electrode.

4. The fixing device according to claim 1, wherein when the controller executes the heat supplying mode, the controller controls the first rotating body or the second rotating body, thereby rotating the first rotating body and the second rotating body.

5. The fixing device according to claim 1, wherein the second heat supplying part is regarded as the first heat supplying part, and wherein when the controller executes the heat supplying mode, the controller controls the first heat supplying part, thereby supplying heat that enables a temperature of the first rotating body to be higher than the heating temperature, to the first heat supplying part and causing the temperature of the discharging electrode to be higher than the heating temperature.

6. An image forming apparatus comprising:

a forming part configured to form toner images on media; and the fixing device according to claim 1, the fixing device configured to fix the toner images, formed by the forming part on the media, to the media.

7. The image forming apparatus according to claim 6, further comprising a user interface configured to cause the controller to execute the heat supplying mode.

8. The image forming apparatus according to claim 6, wherein when the media whose number is predetermined are printed after previous execution of the heat supplying mode, the controller executes the heat supplying mode.

* * * * *